US007320237B2

(12) United States Patent
Kubota et al.

(10) Patent No.: US 7,320,237 B2
(45) Date of Patent: Jan. 22, 2008

(54) METHOD FOR MEASURING MISALIGNMENT OF CONTINUANCE MILL AND APPARATUS FOR MEASURING THE SAME

(75) Inventors: Hiroshi Kubota, Wakayama (JP); Youichi Suzuki, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/399,324

(22) Filed: Apr. 7, 2006

(65) Prior Publication Data

US 2007/0036426 A1 Feb. 15, 2007

Related U.S. Application Data

(63) Continuation of application No. PCT/JP2004/014826, filed on Oct. 7, 2004.

(30) Foreign Application Priority Data

Oct. 7, 2003 (JP) ..... 2003-348790

(51) Int. Cl.
*B21B 31/06* (2006.01)
*B21C 5/00* (2006.01)
*G01B 11/00* (2006.01)

(52) U.S. Cl. ..... 72/10.7; 72/10.1; 72/13.4; 72/31.08; 72/240; 356/153

(58) Field of Classification Search ..... 72/31.07, 72/31.08, 9.5, 10.1, 10.7, 12.1, 13.4, 13.6, 72/208, 234, 204, 224, 247; 356/388–390, 356/394–401, 626, 153; 382/152; 264/408–409, 264/411

See application file for complete search history.

(56) References Cited

U.S. PATENT DOCUMENTS 3,640,109 A * 2/1972 Ashton et al. ..... 72/37
4,548,503 A * 10/1985 Liesch et al. ..... 356/621
4,821,544 A * 4/1989 Tamler et al. ..... 72/14.1
5,355,704 A * 10/1994 Holthoff ..... 72/13.4
5,467,625 A * 11/1995 Holthoff ..... 72/31.07
6,216,518 B1 * 4/2001 Sakurai et al. ..... 72/240

FOREIGN PATENT DOCUMENTS

DE 37 24 982 2/1989
DE 3729176 A1 * 3/1989

(Continued)

*Primary Examiner*—Dmitry Suhol
(74) *Attorney, Agent, or Firm*—Clark and Brody

(57) ABSTRACT

While a reference means having a positional relationship to the pass-line of a continuance mill determined in advance and caliber profile (area enclosed by the groove profile of a rolling roll) formed by a rolling roll at each stand are imaged within the same visual field and a position corresponding to the pass-line is calculated based on the region corresponding to the reference means within the taken image, the center position of the region corresponding to the caliber profile within the taken image is calculated and the misalignment amount of the caliber profile can be calculated based on the calculated center position and the calculated position corresponding to the pass-line. Accordingly, a misalignment amount can be measured accurately as long as images of the reference means and the caliber profile are taken within the same visual field.

20 Claims, 6 Drawing Sheets

FOREIGN PATENT DOCUMENTS

| | | |
|---|---|---|
| JP | 57-121810 | 7/1982 |
| JP | 59-019030 | 1/1984 |
| JP | 3-68901 | 7/1991 |
| JP | 4-33401 | 3/1992 |
| JP | 06-153200 | 5/1994 |
| JP | 2002-035834 | 2/2002 |
| SU | 668142 | 6/1985 |

* cited by examiner

[Normal Binarization Process]

[Sub-PIXEL Process Between Two PIXELs]

METHOD FOR MEASURING MISALIGNMENT OF CONTINUANCE MILL AND APPARATUS FOR MEASURING THE SAME

CROSS-REFERENCE TO RELATED APPLICATION

This application is a continuation of International Patent Application No. PCT/JP2004/014826, filed Oct. 7, 2004. This PCT application was not in English as published under PCT Article 21(2).

TECHNICAL FILED OF THE INVENTION

The present invention relates to a method for measuring a misalignment of a continuance mill and an apparatus for measuring the same for use in rolling steps etc. of steel tubes and pipes or steel rods and wire, wherein a center position of the caliber profile (area enclosed by the grooves of rolling rolls) formed by rolling rolls mounted at each stand can be measured so that both the orientation and amount of misalignment, when being present, are instrumented and utilized for adjusting the position of each rolling roll.

BACKGROUND ART

Conventionally, in a rolling step of seamless steel tubes and pipes, various mills (continuance mill, sizing mill etc.) have been used, where rolling rolls in these rolling mills are always compressed onto high temperature work material, thus requiring the occasional exchange of rolling rolls since the wear thereof is developed relatively fast and/or the defects on the surface of rolling roll happen to be generated. Also, rolling rolls are exchanged according to the size of work material.

When rolling rolls are exchanged in the above cases, it is essential that, after exchanging rolling rolls, each center of caliber profile formed by each rolling roll mounted onto the stand housing of rolling mill shall be aligned on the same line.

Conventionally, it is common that, in exchanging rolling rolls, rolling rolls are mounted onto a prepared stand housing at a roll shop and then are just polished in that condition, so that a gap between any two adjacent rolling rolls can be adjusted so as to be equal in dimension. Namely, it is a common practice that the stand housing with mounted rolling rolls that are polished is set to the rolling mill and any alignment of all stands is not carried out.

As afore-mentioned, since an alignment of a plurality of stands is not performed, a rolling operation is occasionally carried out while a misalignment remains. The misalignment thus left causes not only a poor dimensional accuracy such as wall thickness, outside diameter, and shape but also defects to be attributable to rolling rolls.

To cope with the above problem, various measuring misalignment methods and alignment methods are proposed and put into practice up to date.

In the first place, as a general method, a method for measuring the position of rolling roll in horizontal direction by comparing the position of the piano wire with a plumb bob, that is hung down from the piano wire tautened along a standard pass-line, to the position shown in a design drawing is commonly known in the case that the operation is suspended for a long time in order to get maintenance, repair or the like done.

Meanwhile, the position in vertical direction is measured by comparing the acquired data by means of the optical leveling instrument to the position in the above drawing, and an adequate adjustment of alignment is made according to the extent of misalignment.

As another alignment method, there is proposed a method for adjusting each pair of rolls so as to make the centerpiece of each jig as stated below coincide with the laser beam center, wherein the laser emitting means is disposed in adjacent to an entrance side of a first stand, and wherein a beam detection device to receive the emitted beam from the above laser emitting means is disposed in adjacent to an exit side of rearmost stand, and wherein a releasable jig with the centerpiece being coincided with the center of the space outlined with an approximate circular shape, that is formed by each pair of calibers (rolls), is provided, and wherein the laser beam is emitted from the above laser emitting means so as to be perpendicular to the side face of the first stand (for example, refer to Japanese Patent Application Publication No. 57-121810).

Also, there is proposed an alignment measuring apparatus comprising a barrel-type jig roll having a standard target in the center, being fitted into the space confined by rolling rolls in each stand of a continuance mill, and an optical reading device capable of detecting the center position of said standard target (for example, refer to Japanese Utility Model Publication No. 03-68901).

Further, there is proposed an alignment apparatus for rolling rolls comprising a light source capable of emitting a parallel beam from the entrance side toward the exit in terms of work material flow in a continuance mill, an optical receiver at the exit side in terms of that being capable of receiving the emitted parallel beam, and a calculation and display device capable of determining and displaying the alignment position by means of the relative position of said rolling rolls being calculated based on the received beam data (for example, refer to Japanese Utility Model Publication No. 04-33401).

Besides, there is disclosed an apparatus for measuring caliber profile off-set comprising a light source and a video camera being disposed both in front of and behind the caliber profile formed by a pair of rolls in a single stand mill, wherein the caliber profile off-set picked up by said video camera is displayed on the display device, thereby enabling the caliber profile off-set to be easily determined (for example, refer to Japanese Patent Application Publication No. 59-19030).

However, in the method for tautening the piano wire as above, there remains an issue that it is merely possible to indirectly identify where the rolling rolls are located with respect to the pass-line and the spatial relationship to the contact position between a rolling roll and work material cannot be directly examined. In this regard, when a wall thickness eccentricity attributable to the misalignment due to the off-set of rolling rolls in a continuance mill is caused, it is not possible to measure the required amount of adjustment, and it has only to be indirectly calculated. Moreover, this kind of adjusting method cannot be applied frequently since it is time-consuming, and the alignment accuracy is within about ±1 mm.

Also, either the prior art disclosed in Japanese Patent Application Publication No. 57-121810 or in Japanese Utility Model Publication-No. 03-68901 relates to a method for measuring the alignment of rolling rolls by the relative positional relationship between the center of the jig, being inserted and fitted into the space confined by rolling rolls, and the emitted laser beam. But the caliber profile formed by three rolling rolls has a complex configuration, and in the case that only one rolling roll is off-set, it is structurally difficult for said jig to be properly inserted and fitted so that the jig center is coincided with the alignment center, thereby it is extremely difficult to assure the alignment accuracy.

Further, the apparatus disclosed in Japanese Utility Model Publication No. 04-33401 is used for measuring an alignment center by getting the profile projection of the groove bottom of rolling roll and there is an issue that an alignment center cannot be measured when the rolling mill is tilted with respect to the optical axis, because the apparatus means that only the spatial relationship of the most convex portion of the caliber profile of rolling roll is determined.

Other apparatus disclosed in Japanese Patent Application Publication No. 59-19030 is configured that a light source is disposed outside the stand, and in the case that the plural stands are provided in such a continuance mill there is an issue that the alignment center of rolling rolls to be measured is not distinguished from that of other irrelevant rolling rolls, because an image of each perimeter profile of a plurality of rolling rolls lies one upon another.

In order to address above-mentioned issues and to perform an alignment measurement accurately in a short time, there is proposed an apparatus for measuring an off-set to be put in place at either entrance side or exit side of a continuance mill, comprising an image-taking device being disposed in such a manner that said device is provided as directed toward said continuance mill and an optical axis thereof approximately coincides with the pass-line of said continuance mill, a lighting device that is put in place in each space between stands that constitute a continuance mill and serves to provide light toward rolling rolls to be measured from the opposite side where the image-taking device is disposed, a signal processing device that calculates the off-set amount of relevant rolling roll based on the taken image of relevant rolling roll by the image-taking device (for example, refer to Patent Application Publication No. 2002-35834).

The above apparatus disclosed in the Patent Publication No. 2002-35834 has an advantage that the alignment center of a continuance mill can be measured in a short time and accurately.

However, in the above apparatus disclosed in the Patent Application Publication No. 2002-35834, the image-taking device must be disposed so that the optical axis thereof approximately coincides with the pass-line of the continuance mill, which is time-consuming and affects the measurement accuracy depending on the extent of coincidence of the pass-line with the optical axis.

Further, as the image is taken by a single image-taking device for each caliber profile formed by rolling rolls mounted on the forefront stand through the rearmost stand, a zoom lens is normally applied as the image-taking optical system for the image-taking device. When the lens with common focal distance is applied as the image-taking optical system, the visual field in image-taking for the forefront stand is significantly differed from that for the rearmost stand, which ends up in abating the resolution capacity in the case of the stand far from the image-taking device, thus resulting in the poor measurement accuracy. Meanwhile, it is well known that the change of focal point normally causes the off-set of visual field (cause the off-set of optical axis). This means that, even if the optical axis is adjusted so as to coincide with the pass-line at predetermined focal position of the zoom lens, the optical axis gets off-set from the pass-line at another focal position. Therefore, it becomes extremely difficult to dispose the image-taking device so that the optical axis thereof approximately coincides with the pass-line of a continuance mill at all focal positions.

As afore-mentioned, in the above apparatus disclosed in the Patent Application Publication No. 2002-35834 to solve the problem encountered in the prior art, it is necessary to dispose the image-taking device so that the optical axis thereof approximately coincides with the pass-line of a continuance mill, which is time-consuming and makes it extremely difficult in the case that the zoom lens is applied as the image-taking optical system for image-taking device, and to dispose the image-taking device so that the optical axis thereof approximately coincides with the pass-line of a continuance mill at all focal positions.

SUMMARY OF THE INVENTION

The present invention is made to solve such a problem encountered in the prior art, and the object is to provide a method for measuring a misalignment as well as an apparatus for measuring the same, being capable of measuring said misalignment accurately without coinciding the pass-line of a continuance mill with the optical axis of an image-taking device.

In order to achieve the object, the present invention provides a method for measuring a misalignment amount of caliber profile formed by rolling rolls mounted at each of stands that constitute a continuance mill, comprising the steps of disposing a reference means, whose positional relationship to a pass-line of said continuance mill is determined in advance, at each stand or at each space between any two adjacent stands; taking images of both said caliber profile, formed by rolling rolls mounted onto said each stand, and said reference means within the same visual field; calculating a relative position corresponding to said pass-line within the above taken image based on the region corresponding to said reference means within the above taken image; calculating a relative center position of the region corresponding to said caliber profile within the above taken image; and, calculating a misalignment amount of said caliber profile based on the relative center position thus calculated and the relative position corresponding to the pass-line thus calculated.

According to the invention as above, while the images of both said reference means, whose positional relationship to a pass-line of said continuance mill is determined in advance, and said caliber profile formed by rolling rolls mounted on said each stand are taken, and the relative position corresponding to the pass-line is calculated based on the region corresponding to said reference means within the taken image, the relative center position of the region corresponding to said caliber profile within the taken image is calculated and a misalignment amount of said caliber profile is calculated based on the relative center position thus calculated and the relative position corresponding to the pass-line thus calculated.

Therefore, without coinciding the optical axis in image-taking with the pass-line of said continuance mill, it becomes possible to accurately measure a misalignment amount as long as the images of both reference means and caliber profile are taken within the same visual field. In such a configuration, by disposing a reference means in the vicinity of each rolling roll to be measured in turn and repeating to take images, it becomes possible to accurately measure the alignment of caliber profile in a continuance mill.

Also, the present invention provides an apparatus for measuring a misalignment amount of caliber profile formed by rolling rolls mounted at each of stands that constitute a continuance mill, comprising: a reference means, to be disposed at each space between said stands, whose positional relationship to the pass-line of said continuance mill is determined in advance; an image-taking device that is disposed at the entrance or exit side of said continuance mill as directed toward said continuance mill so as to take images of both said caliber profile formed by rolling rolls mounted at each stand and said reference means within the same visual field; and, a signal processing device (image processing device) being capable of calculating a misalignment amount of said caliber profile based on the taken images by said image-taking device, wherein said signal processing device, while calculating the relative position corresponding to said pass-line within said taken image based on the region corresponding to said reference means within said taken image, calculates the relative center position of the region corresponding to said caliber profile within said taken image and performs processing to calculate a misalignment amount of said caliber profile based on the relative center position thus calculated and the relative position corresponding to said pass-line thus calculated.

Said apparatus for measuring a misalignment amount preferably comprises a lighting device that provides light toward said caliber profile from the opposite side where said image-taking device is disposed.

According to this invention, since the lighting device that provides light toward the caliber profile to be measured can be put in place at each space between any two adjacent stands, a sufficient light can be secured in taking images, thus making it possible to accurately calculate the relative center position of the region corresponding to the caliber profile within the taken image.

Further, said apparatus for measuring a misalignment amount preferably comprises a first target element to be set at each stand or at each space between any two adjacent stands, and a laser beam source that emits a laser beam as directed toward said first target element from the side where said image-taking device is disposed, wherein said reference means comes as a laser spot radiated onto said first target element from said laser beam source.

According to this invention, when the first target element is moved toward the vicinity of each rolling roll to be measured in turn, the laser spot is got onto the first target element owing to the directionality of laser beam, thereby the alignment of caliber profile can be accurately measured by repeating the image-taking process for both relevant laser spot and caliber profile.

It is preferable that said apparatus for measuring a misalignment amount comprises a set of a second target element, whose positional relationship to the pass-line of said continuance mill is determined in advance, to be set at each of two stands of said continuance mill, while being disposed at the side where the laser beam emitted from said laser source is radiated within the visual field of said image-taking device.

According to this invention, the laser spot got onto each second target element that is respectively provided at each of two stands (for instance, forefront stand and rearmost stand) of a continuance mill, being adjusted so as to be in equal distance from the pass-line in both horizontal and vertical directions, thereby making it possible to adjust so that the laser beam becomes approximately in parallel with the pass-line.

In other words, since the positional relationship of each second target element to the pass-line of a continuance mill is determined in advance, it becomes possible for the laser beam to be approximately parallel to the pass-line by adjusting the orientation of the laser beam while observing the laser spot whose image is taken by the image-taking device so that the laser spot can be got onto the predetermined position of each second target element, each of which is in equal distance with respect to the pass-line in both horizontal and vertical directions.

Also, it becomes easy to calculate the relative position corresponding to the pass-line within the taken image based on the laser spot got onto the relevant first target element since the laser spot got onto the first target element also comes to be positioned in equal distance with respect to the pass-line by adjusting the laser beam so as to be approximately parallel to the pass-line.

Besides, said apparatus for measuring a misalignment amount, while being equipped with the laser beam source, preferably comprises a movable stage, making it possible to easily adjust the orientation of laser beam emitted from said laser source.

According to this invention, since the laser source is mounted onto the movable stage such as a X-axis stage (horizontally movable stage), a Z-axis stage (vertically movable stage), a tilt stage and a pan stage, the orientation of the laser beam emitted from said laser source can be easily adjusted.

It is preferable that said image-taking device is further mounted onto said movable stage so that said movable stage makes it possible to adjust the orientation of the laser beam emitted from said laser source in a unified manner with the optical axis of said image-taking device all at once.

According to this invention, since it becomes possible to adjust the orientation of the laser beam emitted from said laser source in a unified manner with the optical axis of said image-taking device, the optical axis of the image-taking device is automatically adjusted to be approximately parallel to the pass-line by adjusting the laser beam to be approximately parallel to the pass-line if the emitted laser beam is adjusted to be approximately parallel to the optical axis of the image-taking device emitted from the laser source.

In the present invention, although it is not essential to adjust the optical axis of the image-taking device to be rigorously parallel to the pass-line as afore-mentioned, the extreme offset between them hinders to take images of both caliber profile and the laser spot at each stand within the same visual field. Therefore, in order to avoid this, it is suitable that the optical axis of the image-taking device is adjusted to be approximately parallel to the pass-line.

Also, said first target element is preferably configured to be able to move within the plane, that is approximately perpendicular to the orientation of said laser beam, at least once in an image-taking cycle by said image-taking device.

According to this invention, since the first target element moves (for instance, rotate or oscillate) in the plane, that is approximately perpendicular to the orientation of said laser beam, at least once within an image-taking cycle (for instance, 1/60 second in the case that the output signal of image-taking device is a NTSC signal), the laser spot to be subjected to an image-taking process comes to be so that the reflected beam of each laser spot got onto the different positions of the first target element is added up by integration calculation.

Therefore, since the laser spot to be subjected to an image-taking process is alleviated from the influence of laser speckle caused by the dents and/or bumps on the surface of the first target element and is obtained as a comparatively clear spot figure, it is possible to calculate the relative position corresponding to the pass-line with utmost accuracy based on the relevant laser spot.

Likewise, said second target element is preferably configured to be able to move in the plane, that is approximately perpendicular to the orientation of said laser beam, at least once in an image-taking cycle by said image-taking device.

In the case that at least three rolling rolls are disposed at each of stands that constitute said continuance mill, said signal processing device is preferably configured to extract the edge portion of said each rolling roll based on the region corresponding to said caliber profile within said taken image, to detect the groove bottommost point of said each rolling roll based on the distance from the edge portion thus extracted to the picture element, PIXEL, or the nearby PIXEL of the relative position corresponding to the pass-line calculated as above, and to calculate the relative center position of the virtual circle, traversing at least three points among the groove bottommost points detected as above of rolling rolls, thereby determining it as the relative center position of the region corresponding to said caliber profile.

According to this invention, the region corresponding to the caliber profile within the taken image is subjected to processing, such as a binarization process, thereby making it possible to extract the perimeter portion, namely the edge portion of rolling roll, and detect the groove bottommost point of each rolling roll (for instance, capable of recognizing the specific perimeter portion, which indicates the longest relevant distance described as below, as the groove bottommost point) based on the distance from the edge portion thus extracted to the picture element, PIXEL, or the nearby PIXEL (for instance, plus or minus 10 PIXEL in horizontal direction in that case that the edge portion of the rolling roll positioned above or below within the taken image ought to be detected) of the relative position calculated as above corresponding to the pass-line.

Since not less than three discrete groove bottommost points thus detected are present, the virtual circle traversing at least three discrete groove bottommost points can be depicted and the center point of this virtual circle can be calculated as the relative center position of the region corresponding to the caliber profile.

Meanwhile, in the case that two rolling rolls are disposed at each of stands that constitute said continuance mill, said signal processing device is preferably configured to extract the edge portion of said each rolling roll based on the region corresponding to said caliber profile within said taken image, to detect the groove bottommost point of said each rolling roll based on the distance from the edge portion thus extracted to the picture element, PIXEL, or the nearby PIXEL of the relative position corresponding to the pass-line calculated as above, and to calculate the midpoint of the line segment spanning the two discrete groove bottommost points, thereby determining it as the relative center position of the region corresponding to said caliber profile.

According to this invention, the region corresponding to the caliber profile within the taken image is subjected to processing, such as a binarization process, thereby making it possible to extract the perimeter portion, namely the edge portion of rolling roll, and detect the groove bottommost point of each rolling roll (for instance, capable of recognizing the specific perimeter portion, which indicates the longest relevant distance described below, as the groove bottommost point) based on the distance from the edge portion thus extracted to the picture element, PIXEL, or the nearby PIXEL (for instance, plus or minus 10 PIXEL in horizontal direction in the case that the edge portion of the rolling roll positioned above or below within the taken image ought to be detected) of the relative position corresponding to the pass-line calculated as above.

The midpoint of the line segment spanning the two discrete groove bottommost points thus detected can be calculated as the relative center position of the region corresponding to the caliber profile.

The above signal processing device preferably extracts the edge portion of said each rolling roll by a sub-PIXEL process based on the density gradient between two adjacent PIXELs.

According to this invention, since the edge portion of rolling roll is not extracted by a simple binarization process but extracted by a sub-PIXEL process based on the density gradient between two adjacent PIXELs, the accuracy in extracting the edge portion of rolling roll, consequently the calculation accuracy of the relative center position of the region corresponding to the caliber profile can be enhanced.

Further, said signal processing device preferably comprises an image memory with not less than 10-bit grayscale and is configured to execute an image-processing operation on the images taken into said image memory.

According to this invention, since an image-processing operation is executed for the images taken into the image memory with not less than 10-bit grayscale, compared to the case of adopting the image memory with normal 8-bit grayscale, the density resolution capacity increases from 256 grayscale to 1024 grayscale, thereby enabling the edge portion of rolling roll to be extracted with utmost accuracy.

The present invention makes it possible to take images of both the reference means, whose positional relationship with the pass-line of said continuance mill is determined in advance, and the caliber profile (area enclosed by the groove profile of rolling roll) formed by rolling rolls mounted at each stand within the same visual field, to calculate the relative center position of the region corresponding to said caliber profile within said taken image while calculating the relative position corresponding to said pass-line within said taken image based on the region corresponding to said reference means within said taken image, and to calculate a misalignment amount of said caliber profile based on both the relative center position thus calculated and the relative position corresponding to said pass-line thus calculated.

Therefore, the present invention exhibits remarkable effect that it becomes possible to accurately measure a misalignment amount without rigorously coinciding the optical axis in image-taking with the pass-line of said continuance mill as long as the images of both reference means and caliber profile are taken within the same visual field.

DESCRIPTION OF THE PREFERRED EMBODIMENTS

With reference to the attached drawings, one of embodiments of the present invention is described as below.

Figure 1:
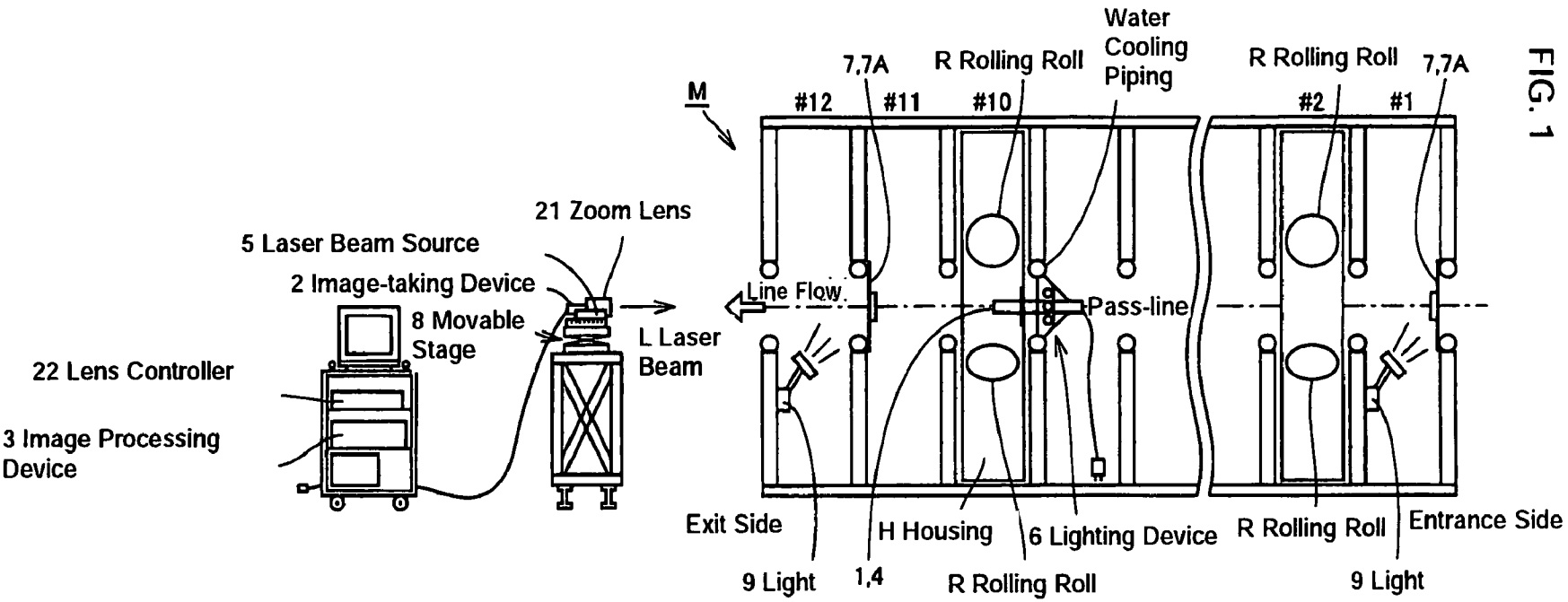
FIG. 1 is a side view showing the configuration outline of the apparatus for measuring a misalignment amount in relation to the embodiment of the present invention.

FIG. 1 is a side view showing the configuration outline of the apparatus for measuring a misalignment amount in relation to the embodiment of the present invention. The continuance mill M in this embodiment is represented by a sizer mill with 12 stands in all where three rolling rolls R are mounted onto each housing H of stand.

As shown in FIG. 1, the apparatus for measuring a misalignment amount in relation to the present embodiment is employed to measure a misalignment amount of the caliber profile (an area enclosed by each groove profile of rolling rolls in each stand) formed by rolling rolls R (for the sake of simplicity, only #2 and #10 are shown in the view) mounted onto each stand (#1-#12) that constitutes the continuance mill M, comprising a reference means 1, an image-taking device 2 and a signal processing device 3 (an image-processing device).

Besides, said apparatus for measuring a misalignment amount in relation to this embodiment comprises a first target element 4 to be set at each stand or at each space between any two adjacent stands (at each stand in this embodiment), and a laser beam source 5 that emits a laser beam L as directed toward said first target element 4 from the site where said image-taking device 2 is disposed.

Further, said apparatus for measuring a misalignment amount in relation to this embodiment comprises a lighting device 6, a correction jig 7A having a second target element 7 thereon, and a movable stage 8.

The reference means 1 is disposed at each stand or at each space between two adjacent stands (at each stand in this embodiment), wherein the positional relationship thereof to the pass-line of the continuance mill M is determined in advance. To be more concrete, the reference means 1 in this embodiment refers to the laser spot got onto the first target element 4.

With regard to the laser beam L emitted from the laser beam source 5, when the positional relationship thereof to the pass-line of the continuance mill M is determined in advance, the positional relationship of the laser spot got onto the first target element 4 with the continuance mill M is also determined beforehand.

Besides, the first target element 4 is also attached to the lighting device 6 as described below wherein said lighting device 6 is set at the predetermined location between two adjacent stands, whereby the positional relationship of the laser spot got onto the first target element 4 with the pass-line of the continuance mill M can be determined.

The image-taking device 2 is disposed at the entrance or exit side (at exit side in this embodiment) of the continuance mill M, with respect to the continuance mill M, so as to take images of both said caliber profile, formed by rolling rolls R mounted at each stand, and the laser spot (the reference means 1) within the same visual field. The image-taking device 2 in relation to this embodiment utilizes a 2-dimensional CCD camera that is equipped with a zoom lens 21 in combination of a lens controller 22 serving to adjust the extent of the zoom of the zoom lens 21.

The signal processing device 3 comprises an image memory with not less than 10-bit grayscale and an image-processing process is executed for the images taken into said image memory by the image-taking device 2 to calculate the misalignment amount of said caliber profile. To be more concrete, the signal processing device 3 calculates the relative position corresponding to the pass-line within said taken image based on the position of the laser spot within said taken image.

And then, the relative center position of the region corresponding to said caliber profile within said taken image is calculated and said misalignment amount is calculated based on both said relative center position thus calculated and said relative position corresponding to said pass-line thus calculated within said taken image.

Both the image-taking device 2 and the signal processing device 3 are configured to have the resolution capacity of not less than 1 million PIXELs (1000×1000) in order to enhance the measurement accuracy, and the visual field of the image-taking device 2 is set to be a square with the length of side approximately 500 mm at each stand (#1-#12).

The laser beam source 5 is mounted onto the movable stage 8 so as to adjust the orientation of the laser beam L emitted from said laser beam source 5. To be more concrete, the movable stage 8 comprises a tilt stage and a Z-axis stage (movable stage in vertical direction) for up and down displacement adjustment of the laser beam L, as well as a pan stage (able to rotate in the plane perpendicular to the paper face in FIG. 1) and a X-axis stage (movable stage in horizontal direction: movable perpendicularly to the paper face in FIG. 1) for horizontal displacement adjustment of the laser beam L, having the laser beam source 5 mounted thereon.

Figure 2A:
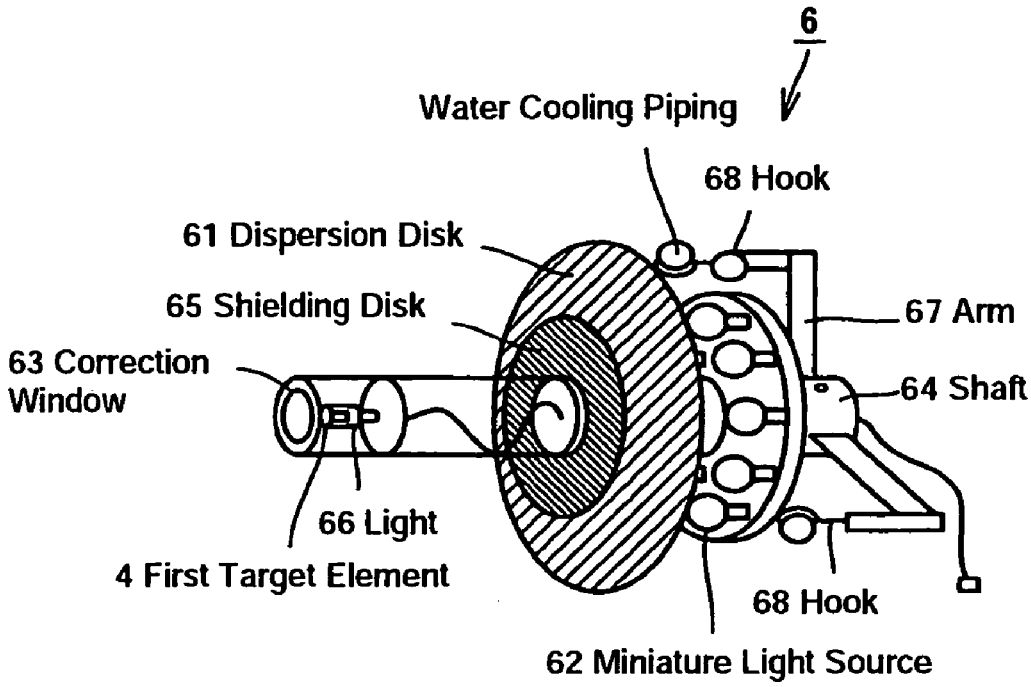
FIG. 2 is a diagram showing the configuration outline of a lighting device whereas 2A is a perspective view, and whereas 2B is a front elevation view indicating the case of being put in place at the space between stands.
Figure 2B:
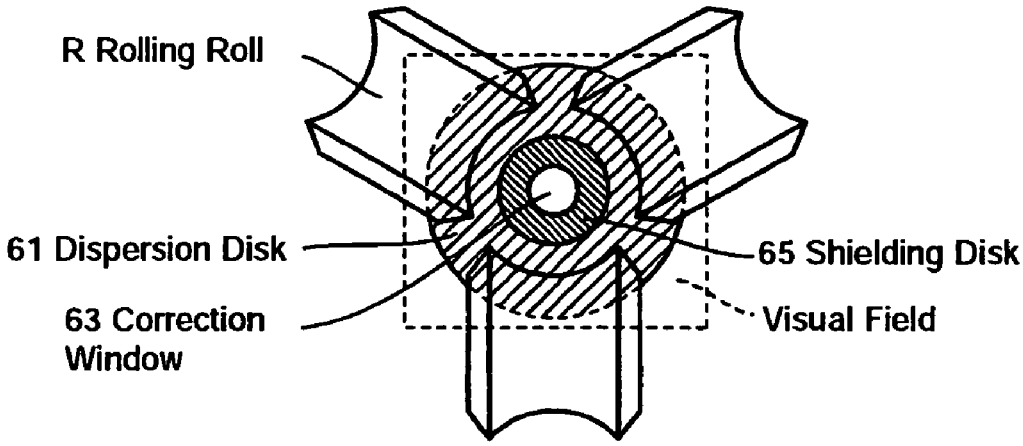

FIG. 2 is the diagram showing the configuration outline of the lighting device whereas 2A is the perspective view, and whereas 2B is the front elevation view indicating the case of being put in place at the space between stands. The lighting device 6, as shown in the above FIG. 1, is disposed at each space between two adjacent stands and illuminates said caliber profile from the opposite side where the image-taking device 2 is disposed. Accordingly, as shown in FIG. 2, the lighting device 6 comprises a dispersion disk 61 and a plurality of miniature light sources 62 that are disposed in a ring manner behind the dispersion disk 61.

Although, in this embodiment, a white lamp with 40 W is used as a miniature light sources 62, other light sources such as a halogen lamp can be respectively used. Yet, a fluorescent light using a public power supply causes shimmering of 60 Hz, which is not preferable and the power supply with high frequency must be used.

A white opaque resin of ABC is used as a material for the dispersion disk 61, but it is also possible to select any one in a series of various materials as long as they belong to white-type substances such as Teflon (registered Trade Mark) that allow the transmission and scatter of light beam.

The dispersion disk 61 can shield off the edge portion of rolling roll R becoming a background scene, whereby the signal processing device 3 is prohibited from erroneously identifying the edge portion of rolling roll R becoming the measuring object.

The lighting device 6 comprises a shaft 64 over which the miniature light source 62 and the dispersion disk 61 can slide. Thus, the positions of the miniature light source 62 and the dispersion disk 61 can be adjusted, thereby making it possible to give proper illumination in accordance with the surface condition and/or the size of rolling roll R.

Besides, the lighting device 6 comprises a black-like shielding disk 65. By such a shielding disk 65, either a measurement error due to the diffraction of light toward the rolling roll R to be measured or a halation due to excessive lighting can be avoided. In this regard, it is preferable for this shielding disk 65 to have a proper dimension depending on the size of rolling roll R.

Further, a correction window 63 made of the same material with the dispersion disk 61 is framed onto the front end of the central section of the lighting device 6, so as to be illuminated from behind by a light 66. The first target element 4 is arranged at one side of this correction window 63. The first target element 4 is connected with a rotary motor (not shown) by a shaft so as to rotate in the plane perpendicular to the orientation of the laser beam emitted from the laser beam source 5 at least once within an image-taking cycle by the image-taking device 2.

The lighting device 6 with the above configuration is disposed at each space between two adjacent stands in such a manner that a hook 68 disposed at the end of an arm 67 extending radially from the shaft 64 is engaged with the water cooling pipe that is fixed onto the side wall of each stand for use in cooling the rolling roll R. It is preferable that the lighting device 6 is positioned near the center of the caliber profile as much as possible, but it is permissable to be positioned within the region as far as the laser spot does not miss the first target element 4.

As shown in FIG. 1 above, in two stands (#1 and #11 in this embodiment) of the continuance mill M, the second target element 7 is disposed at the location, within the visual field for the image-taking device 2, that the laser beam L emitted from the laser beam source 5 is radiated. Thus, the positional relationship of the second target element 7 to the pass-line of the continuance mill M can be determined in advance.

To be more concrete, the correction jig 7A is attached at the predetermined location of #1 stand and #11 stand, and the positional relationship thereof to the pass-line of the continuance mill M is determined in advance. Therefore, regarding the second target element 7 attached to the correction jig 7A, the positional relationship thereof to the pass-line of the continuance mill M also comes to be determined in advance.

Further, the second target element 7 is connected with a rotary motor (not shown) by a shaft so as to rotate in the plane perpendicular to the orientation of the laser beam emitted from the laser beam source 5 at least once within an image-taking cycle by the image-taking device 2. And the correction jig 7A is illuminated by a light 9.

In the following, the method for measuring a misalignment amount by using the apparatus for measuring a misalignment amount with the above configuration is recited.

(1) Sequence 1: Adjustment of Laser Beam Orientation

The orientation of the laser beam L is adjusted by means of the movable stage 8 so that the laser beam L emitted from the laser beam source 5 becomes parallel to the pass-line of the continuance mill M. To be concrete, firstly, the laser beam source 5 and the image-taking device 2 are mounted onto the movable stage 8, and then are set at the exit side of the continuance mill M while the laser beam L emitted from the laser beam source 5 being beforehand adjusted to be approximately parallel to the optical axis of the image-taking device 2 (for instance, disposing physically the frame structure of the laser beam source 5 to be approximately parallel to the frame structure of the image-taking device 2).

Then, at each stand (#1 and #11) of the continuance mill M, one correction jig 7A is set. To be concrete, to facilitate positioning with respect to the pass-line, the correction jig 7A is mounted onto the fixtures, that are secured on both sidewalls of each stand, by fastening bolts while being pressed and leaned toward the one side, and is illuminated by a light 9.

In the correction jig 7A as above, the dimensional and positional condition is predetermined so that the center of gravity of the second target element 7 attached to said correction jig 7A lies in equal distance from the pass-line in both horizontal and vertical directions.

Then, after one of correction jigs 7A is subjected to an image-taking process by the image-taking device 2, and the image thus taken is memorized in the signal processing device 3, the zoom of zoom lens 21 is varied (so as to be approximately same magnification) to take the image of another correction jig 7A.

Figure 3A:
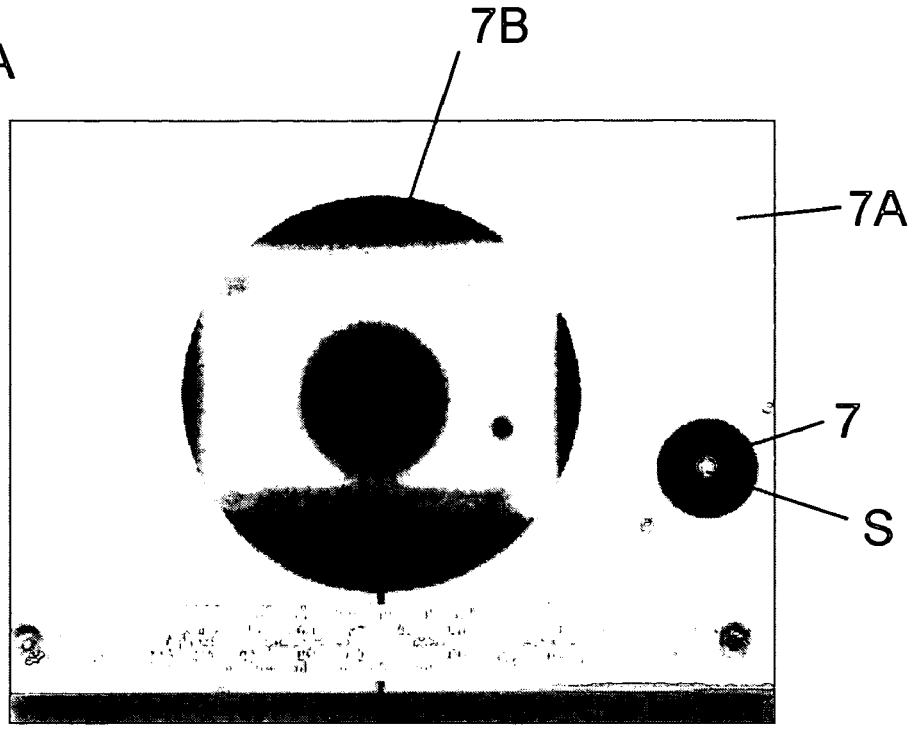
FIG. 3 is an example illustrating the image of a correction jig taken by an image-taking device, whereas 3A indicates a raw image, and whereas 3B indicates the image subjected to a binarization process by a signal processing device 3 (image processing device).
Figure 3B:
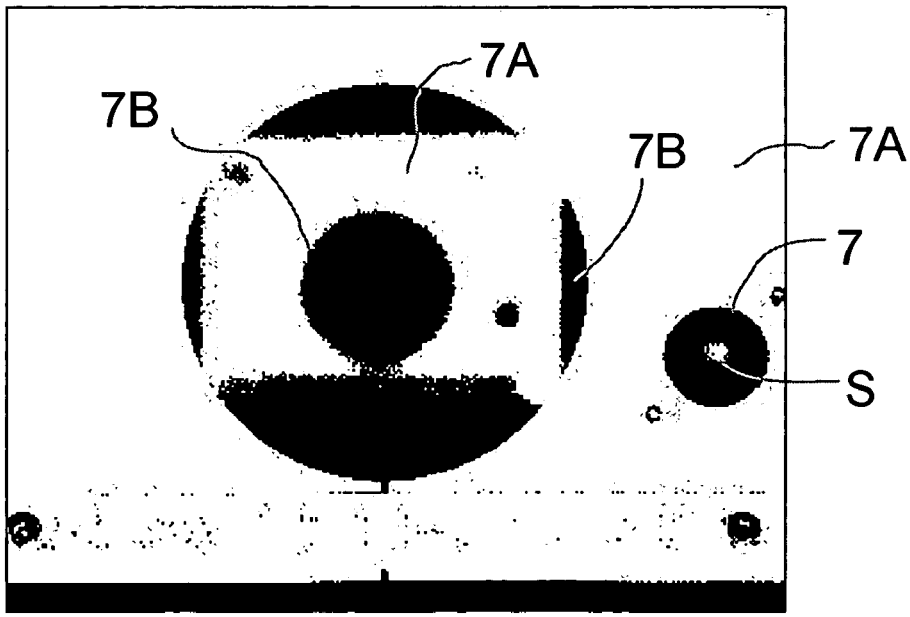

FIG. 3 is an example illustrating the image of a correction jig taken by an image-taking device, whereas (a) indicates a raw image, and whereas (b) indicates the image subjected to a binarization process by a signal processing device 3. The taken image shown in FIG. 3 is an example for the front correction jig 7A (the correction jig mounted onto #11), and, as shown, the taken image includes the region corresponding to the second target element 7, that is attached to the correction jig 7A, as well as the region corresponding to the laser spot S got onto the second target element 7.

Further, as an opening 7B is framed at the center section of the correction jig 7A, it is possible to take an image of another correction jig 7A (the correction jig mounted onto #1) through this opening 7B.

Next, after the taken image of each correction jig 7A that is memorized in the signal processing device 3 is subjected to a binarization process with a predetermined threshold, the region corresponding to the second target element 7 is segmented, and the center of gravity (X1, Y1) of the region corresponding to the second target element 7 along with the center of gravity (X2, Y2) of the region corresponding to the laser spot S is calculated. Here, each center of gravity, (X1, Y1), (X2, Y2) is converted into full scale in order to facilitate the adjustment by the movable stage 8, based on the scaling factor between the actual size of the second target element 7 (20 mm of diameter in this embodiment) and the relative dimension (PIXEL unit) of the second target element 7 in the taken image.

By shifting the movable stage 8 so that the difference between the centers of gravity, (X1, Y1), (X2, Y2) thus calculated in the taken image falls within the predetermined range, it becomes possible to adjust so that the laser beam L emitted from the laser beam source 5 is approximately parallel to the pass-line of the continuance mill M.

As the procedure for shifting the movable stage 8, for instance, the followings are conceivable, namely: (a) an up and down displacement adjustment (after adjusting the slope of the tilt stage so that the difference between Y1 and Y2 becomes approximately equal in each taken image, the height of Z-axis stage is adjusted so that the difference between Y1 and Y2 comes near to zero), and then; (b) a horizontal displacement adjustment (after adjusting the angle of rotation of the pan stage so that the difference between X1 and X2 becomes approximately equal in each taken image, the position of X-axis stage is adjusted so that the difference between X1 and X2 comes near to zero). It is also possible to adopt the procedure that reverses the order of (a) and (b) above.

In this embodiment, the above calculation of the center of gravity (X1, Y1), (X2, Y2), the above up and down displacement adjustment (adjustment of the tilt stage, adjustment of the Z-axis stage), and the above horizontal adjustment (adjustment of the pan stage, adjustment of the X-axis) are configured to be automatically made by the above signal processing device 3, thereby enabling the adjustment to be made very easily.

Thus, after adjusting so that the laser beam L is approximately parallel to the pass-line, the optical axis of the image-taking device 2 is adjusted naturally and automatically so as to be approximately parallel to the pass-line since the image-taking device 2 is mounted on the same movable stage 8 with the laser beam source 5.

As afore-mentioned, the second target element 7 is connected with the rotary motor (not shown) by the shaft, so the second target element 7 can be rotated by enacting said rotary motor when the image of the correction jig 7A is taken by the image-taking device 2.

FIG. 4 is the enlarged view of the region corresponding to the laser spot S that is included in the taken image, whereas 4A indicates the view of the taken image in the case that the second target element 7 stands still, and whereas 4B indicates the view of the taken image in the case that the second target element 7 is rotated.

Figure 4A:
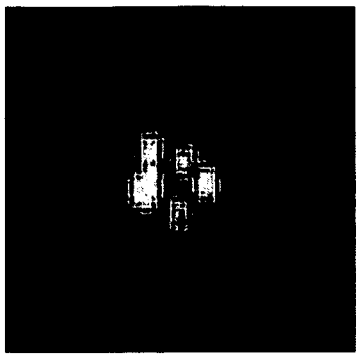
FIG. 4 is an enlarged view of the region corresponding to the laser spot S that is included in the taken image, whereas 4A indicates the view of the taken image of the case that a second target element stands still, and whereas 4B indicates the view of the taken image of the case that the second target element is rotated.
Figure 4B:
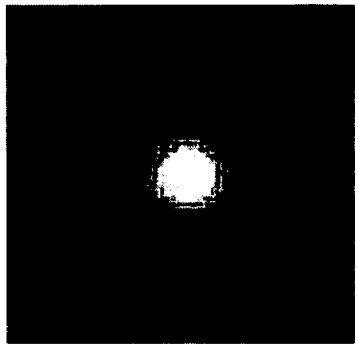

As shown in FIG. 4A, in the case that the second target element 7 stands still, there arises an influence of the laser speckle caused by the dents and bumps on the surface of the second target element 7. However, as shown in FIG. 4B, in the case that the second target element 7 is rotated, the laser spot S subjected to an image-taking process is alleviated from the influence of the laser speckle to thereby enable the clear spot figure to be obtained since the reflected beam of each laser spot S radiated onto the different positions of the second target element 7 is added up by integration calculation during an image-taking process.

(2) Sequence 2: Dimensional Correction

Correction is made to indicate the calculated misalignment amount of rolling roll R by an actual dimension, a full scale. To be concrete, firstly, after the lighting device 6 is disposed behind the rolling roll R to be measured, the miniature light source 62 and the light 66 are turned on. Next, the zoom of the zoom lens 21 is varied so as to adjust the visual field at the location of rolling roll R to be measured.

Incidentally, the change of the zoom of the zoom lens 21 can be done either by manual operation of the relevant switch of the lens controller 22 or by a simplified method in such a way that automatic zooming can be completed by inputting the identification number of the stand to be measured into the lens controller 22 that is configured to have a preset function.

In parallel, the signal processing device 3 has the function to calculate the density profile and density histogram for the arbitrary region within the taken image and to display on the monitoring screen, whereby not only the adjustment of the pint and/or aperture of the zoom lens 21 but also the brightness adjustment of the lighting device 6 can be made simply and easily. After turning on the lighting device 6 and varying the zoom of the zoom lens 21, the caliber profile formed by rolling roll R is subjected to an image-taking process by the image-taking device 2.

Also, the region corresponding to the correction window 63 that is subjected to an image-taking process at the same time is extracted by the signal processing device 3 (extract by a binarization process etc.). And followed by comparison between the extracted relative dimension of the correction window 63 and the actual size (100 mm of diameter in this embodiment), the correction factor (conversion ratio) for the actual size is calculated. In calculating the relative dimension (diameter) of the correction window 63, the maximum diameter in the taken image is preferably adopted so as to minimize the correction error in the case that the correction window 63 happens to tilt.

(3) Sequence 3: Calculation of Misalignment Amount

The misalignment amount of the caliber profile is calculated for each stand. To be concrete, firstly, while the laser beam is emitted from the laser beam source 5 as directed toward the first target element 4 that rotates, the image of the caliber profile is taken under the illumination of the homogeneous light, by the miniature light source 62 via the dispersion disk 61, for the rolling roll R to be measured.

Figure 5:
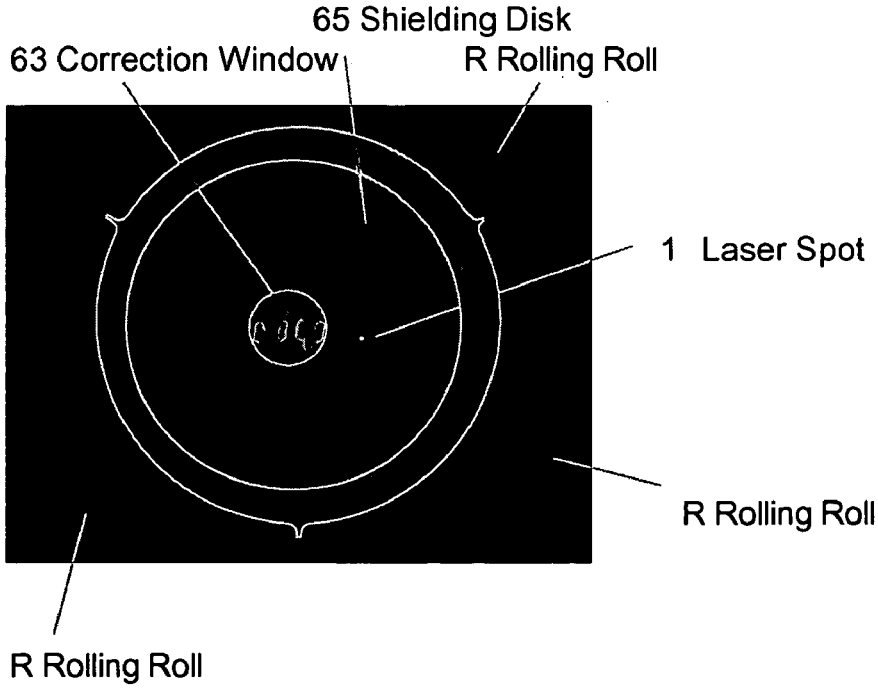
FIG. 5 is a schematic view showing an example of the taken image.

FIG. 5 is the schematic view showing the example of the taken image. Next, by the signal processing device 3, as shown in FIG. 5, the relative position within the taken image corresponding to the pass-line is calculated based on the relative region corresponding to the laser spot 1 within the taken image. To be more concrete, firstly, the center of gravity of the region corresponding to the laser spot is calculated, and then the relative position (machine center) corresponding to the pass-line within the taken image is calculated based on the positional relationship between the center of gravity of the laser spot and the pass-line memorized in the signal processing device 3 beforehand.

Secondly, by applying the sub-PIXEL process, to be described below, to the region corresponding to the caliber profile within the taken image, the edge portion of each rolling roll R is extracted.

FIG. 6 is the illustration explaining the sub-PIXEL process to be employed when the edge portion of each rolling roll R is extracted, whereas 6A indicates the concept of the normal binarization process, and whereas 6B indicates the sub-PIXEL process. The signal processing device 3 in this embodiment adopts an algorithm to extract the edge portion of each rolling roll R by applying the sub-PIXEL process based on the density gradient between two adjacent PIXELs.

Figure 6A:
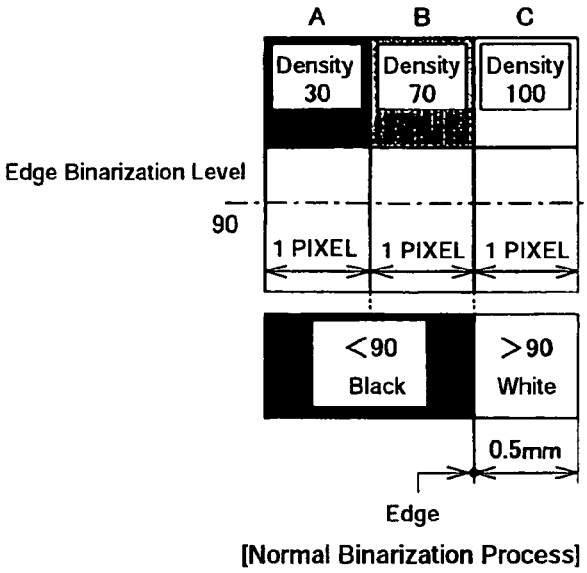
FIG. 6 is an illustration explaining the sub-PIXEL process to be employed when the edge portion of each rolling roll is extracted, whereas 6A indicates the concept of a normal binarization process, and whereas 6B indicates a sub-PIXEL process.

As shown in FIG. 6A, supposed that each of three consecutive PIXELs A, B, C in the vicinity of the edge portion has the density of 30, 70, 100 respectively, and the threshold (binarized level) of binarization process is set to 90, the PIXEL C corresponds to the edge portion being detected by the normal binarization process, consequently the resolution capacity becomes one PIXEL unit (0.5 mm in this embodiment).

Figure 6B:
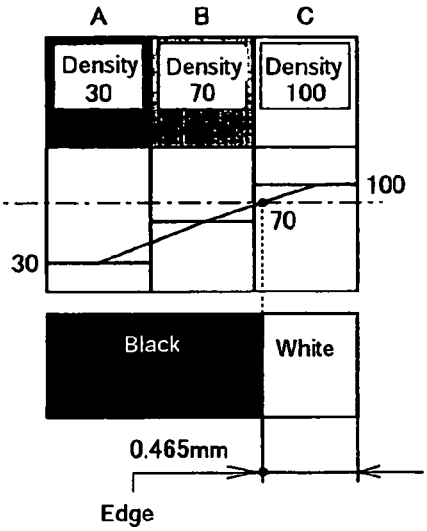

In contrast, as shown in FIG. 6B, in two adjacent PIXELs while one has a lower density than the binarized level and the other has higher density than the binarized level, by applying the sub-PIXEL process based on the density gradient between said two PIXELs (PIXEL B and PIXEL C), in other word, by interpolating the point having the density of the binarized level based on the density between two adjacent PIXELs, the edge portion can be detected with the resolution capacity equal to and lower than one PIXEL unit.

In this embodiment, as a level to be doubled for application of the sub-PIXEL process, the average density of the region corresponding to the correction window 63 within the taken image is adopted.

Figure 7:
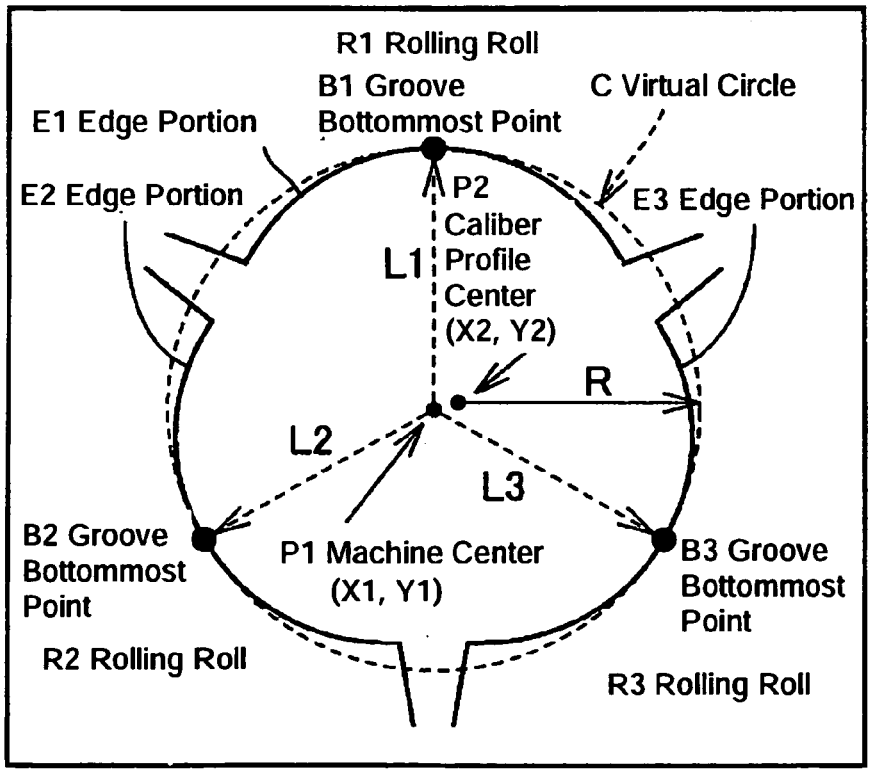
FIG. 7 is an illustration explaining the method for detecting a groove bottommost point of each rolling roll diagram.

FIG. 7 is the illustration explaining the detecting method for the groove bottommost point. Based on the extracted edge portion as above and the distance from it to the calculated PIXEL or the nearby PIXEL as above corresponding to the machine center thereof, the groove bottommost point of said each rolling roll R is detected. As shown in FIG. 7, when the groove bottom (groove bottommost point B1) of rolling roll R1 resting at upper location is detected, in addition to the vertical distance between the extracted edge portion E1 and the PIXEL corresponding to the machine center P1 (X1, Y1), the vertical distance between said E1 and the nearby PIXEL (between −10 PIXELs and +10 PIXELs in horizontal direction with respect to the machine center P1 in this embodiment) of the PIXEL corresponding to the machine center P1 is calculated, whereby the PIXEL of the edge portion E1 that is located at the furthest calculated distance is detected as the groove bottommost point B1.

Next, when the groove bottom (groove bottommost point B2) of rolling roll R2 resting at lower left location is detected, for instance, the whole taken image is rotated clockwise about the machine center P1 by 120 degree, whereby the PIXEL of the edge portion E2 that is located at the furthest calculated distance is detected as the groove bottommost point B2, as described above.

When the groove bottom (groove bottommost point B3) of rolling roll R3 resting at lower right location is detected, for instance, the whole taken image is rotated counterclockwise about the machine center P1 by 120 degree, whereby the PIXEL of the edge portion E3 that is located at the furthest calculated distance is detected as the groove bottommost point B3, as described above.

Next, the signal processing device 3 works out to depict and determine the virtual circle C, traversing the above three discrete groove bottommost points B1, B2, B3, and the center point thereof as the relative center position (caliber profile center) P2 (X2, Y2) of the region corresponding to the above caliber profile. The misalignment amount is calculated based on the machine center (X1, Y1) and the caliber profile center (X2, Y2). To be more concrete, the misalignment amounts in horizontal direction and in vertical direction are obtained by the formula X1-X2 and the formula Y1-Y2, respectively.

Now, given that L1 is the distance from the groove bottommost point B1 to the machine center P1, L2 is the distance from the groove bottommost point B2 to the machine center P1, L3 is the distance from the groove bottommost point B3 to the machine center P1, and R is the radius of the virtual circle C, the correction amounts for the positions of rolling rolls R1, R2, R3 to coincide the machine center P1 with the caliber profile center P2 are obtained by the formulae R-L1, R-L2 and R-L3, respectively.

Although this embodiment describes the case that three rolling rolls are mounted onto each stand, the present invention is not limited to this case and can be applied to the continuance mill comprising each stand with two rolling rolls that are disposed as opposed to each other. However, in the case of this kind of continuance mill, since only two groove bottommost points are detected, the virtual circle traversing relevant groove bottommost points cannot be uniquely determined, namely, it cannot be only one.

Therefore, in the case of this kind of continuance mill, for instance, after the whole image is rotated about the machine center P1 by predetermined angle so that one of extracted edge portions lies above and the other lies below, the groove bottommost point of each rolling roll is detected in the same manner with the case above that three rolling rolls are mounted. And then, the midpoint of the line segment spanning the two discrete groove bottommost points thus detected can be calculated and determined as the relative center position of the region corresponding to said caliber profile.

(4) Sequence 4: Measurement at Following Stands

Next, in order to calculate the misalignment amount in all stands, the caliber profile center at other stand is measured in turn. To be concrete, after completion of the above Sequence 3, the lighting device 6 is dismounted and then the operation gets started from Sequence 2 for the rolling rolls R to be measured next. By applying the same procedure for all rest of rolling rolls that constitute the continuance mill M, the position coordinates of each caliber profile center for all stands can be calculated.

(5) Sequence 5: Display of Present Misalignment

Lastly, in order to visually recognize the misalignment amount at each stand, the present misalignment through all stands is displayed. To be concrete, when the measurement for other stands to be measured in accordance with Sequence 2-4 is completed, each misalignment amount of the caliber profile at each stand with respect to the pass-line is comprehensively arrayed and displayed on the monitor screen connected to the signal processing device 3 (image processing device).

Figure 8A:
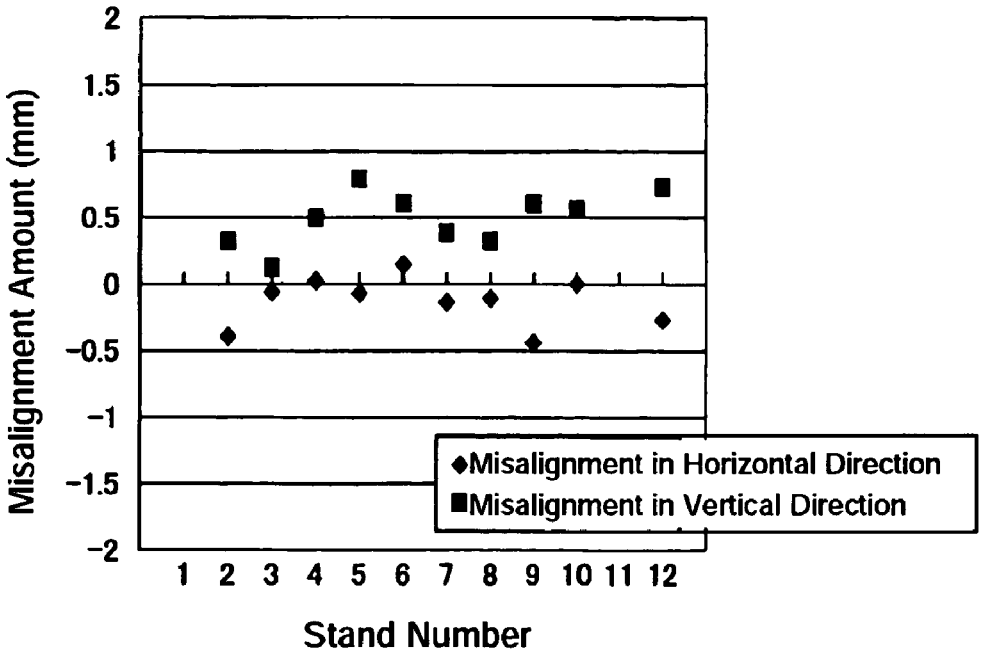
FIG. 8 is a diagram showing a misalignment amount in measurement, whereas (a) indicates the misalignment amount before correction of misalignment, and whereas (b) indicates the misalignment amount after correction of misalignment.

FIG. 8 is the diagram showing the misalignment amount in measurement, whereas 8A indicates the misalignment amount before correction of misalignment, and whereas 8B indicates the misalignment amount after correction of misalignment. By displaying this kind of results on the monitor screen, it can be easily grasped how much and which rolling roll must be corrected for its position as the status of each rolling roll R and/or its positional relationship with each other can be recognized at one scene.

Figure 8B:
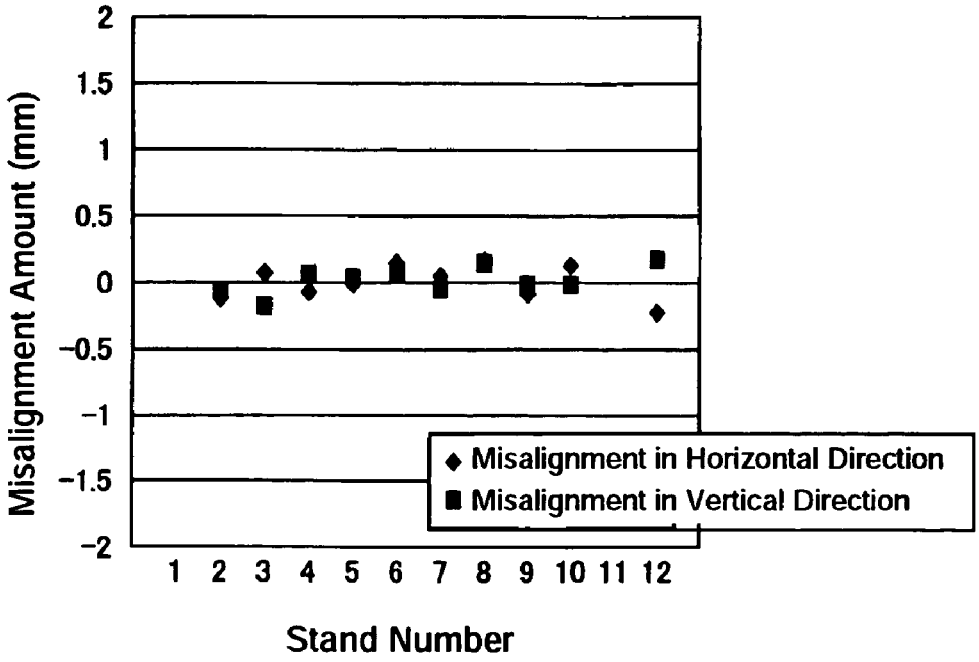

Since the required correction amount of the position of each rolling roll for correcting the misalignment is calculated by the signal processing device 3 as above, this can be also configured to be displayed on the monitor screen. As shown in FIG. 8B, by employing the apparatus for measuring the misalignment amount in relation to this embodiment, it becomes possible to enhance the alignment accuracy from about plus or minus 1 mm to plus or minus 0.5 mm or less.

By using the measuring apparatus according to the present invention, the alignment measurement that used to be normally carried out about once every three months and used to take two or three days at a time can be done on the basis of once or more a month which corresponds to the roll setup change and furthermore can be completed within two hours at a time. Moreover, the misalignment amount of each rolling roll after being set in on-line system is measured, and the adjustment is made based on the obtained results, whereby the faulty product such as the wall thickness eccentricity and/or defects attributable to the misalignment decreases in number and it becomes possible to improve the product quality.

INDUSTRIAL APPLICABILITY

The method for measuring the misalignment amount in the continuance mill and the apparatus for measuring the same by the present invention make it possible to take images of both the reference means whose positional relationship to the pass-line of said continuance mill is determined in advance and the caliber profile (area enclosed by the groove profile of rolling roll) formed by rolling rolls mounted at each stand within the same visual field, to calculate the relative center position of the region corresponding to said caliber profile within said taken image while calculating the relative position corresponding to said pass-line within said taken image based on the region corresponding to said reference means within said taken image, and to calculate a misalignment amount of said caliber profile based on both the relative center position thus calculated and the relative position corresponding to said pass-line thus calculated.

Therefore, it becomes possible to accurately measure a misalignment amount without coinciding the optical axis in image-taking with the pass-line of said continuance mill as long as the images of both reference means and caliber profile are taken within the same visual field. Further, the adjustment was made based on the results thus obtained, whereby the faulty product such as the wall thickness eccentricity and/or defects attributable to the misalignment decreases in number and it becomes possible to improve the product quality. Thus, the present invention can be widely applied.

What is claimed is:

1. A method for measuring a misalignment amount of caliber profile formed by rolling rolls mounted at each of stands that constitute a continuance mill, comprising the steps of:

disposing a reference means, whose positional relationship to a pass-line of said continuance mill is determined in advance, at each space between any two adjacent stands;

taking images of both said caliber profile, formed by rolling rolls mounted onto said each stand, and said reference means within the same visual field;

calculating a relative position corresponding to said pass-line within the above taken image based on the region corresponding to said reference means within the above taken image;

calculating a relative center position of the region corresponding to said caliber profile within the above taken image; and, calculating a misalignment amount of said caliber profile based on the relative center position thus calculated and the relative position corresponding to the pass-line thus calculated.

2. An apparatus for measuring a misalignment amount of caliber profile formed by rolling rolls mounted at each of stands that constitute a continuance mill, comprising:

a reference means, whose positional relationship to a pass-line of said continuance mill is determined in advance, at each space between any two adjacent stands;

an image-taking device that is disposed at the entrance or exit side of said continuance mill as directed toward said continuance mill so as to take images of both said caliber profile, formed by rolling rolls mounted onto said each of stands, and said reference means within the same visual field; and, an image processing device being capable of calculating a misalignment amount of said caliber profile based on the above taken images by said image-taking device, wherein, while calculating a relative position corresponding to said pass-line within the above taken image based on the region corresponding to said reference means within the above taken image, said image processing device calculates a relative center position of the region corresponding to said caliber profile within the above taken image, and performs processing to calculate the misalignment amount of said caliber profile based on said relative center position thus calculated and said relative position corresponding to the pass-line thus calculated.

3. An apparatus for measuring a misalignment amount according to claim 2, comprising a lighting device accompanied with a first target element that provides light toward said caliber profile from the opposite side where said image-taking device is disposed.

4. An apparatus for measuring a misalignment amount according to claim 3 in which at least three rolling rolls are disposed at each of stands that constitute said continuance mill, wherein said image processing device is capable of:

extracting the edge portion of said each rolling roll based on the region corresponding to said caliber profile within the above taken image;

detecting the groove bottommost point of said each rolling roll based on the distance from the edge portion extracted as above to a PIXEL or the nearby PIXEL of the relative position calculated as above corresponding to the pass-line; and, calculating the relative center position of the virtual circle, traversing at least three groove bottommost points among the groove bottommost points of rolling rolls detected as above, to determine the relative center position of the region corresponding to said caliber profile.

5. An apparatus for measuring a misalignment amount according to claim 3 in which two rolling rolls are disposed at each of stands that constitute said multi-stage rolling mill, wherein said image processing device is capable of:

extracting the edge portion of said each rolling roll based on the region corresponding to said caliber profile within the above taken image;

detecting the groove bottommost point of said each rolling roll based on the distance from the edge portion extracted as above to a PIXEL or the nearby PIXEL of the relative position calculated as above corresponding to the pass-line; and, calculating the midpoint of the line segment spanning the two discrete groove bottommost points to determine the relative center position of the region corresponding to said caliber profile.

6. An apparatus for measuring a misalignment amount according to claim 3, wherein said image processing device comprises an image memory of not less than 10-bit gray-scale to thereby apply processing steps for the images taken into said image memory.

7. An apparatus for measuring a misalignment amount according to claim 2, comprising:

a first target element to be set at each stand or at each space between any two adjacent stands; and, a laser beam source that emits a laser beam as directed toward said first target element from the side where said image-taking device is disposed, wherein said reference means comes as a laser spot got onto said first target element.

8. An apparatus for measuring a misalignment amount according to claim 3, comprising:

a first target element to be set at each stand or at each space between any two adjacent stands; and, a laser beam source that emits a laser beam as directed toward said first target element from the side where said image-taking device is disposed, wherein said reference means comes as a laser spot got onto said first target element.

9. An apparatus for measuring a misalignment amount according to claim 7, comprising a second target element, whose positional relationship to the pass-line of said continuance mill is determined in advance, to be disposed at each of two stands of said continuance mill so that the laser beam emitted from said laser source is radiated within the visual field of said image-taking device.

10. An apparatus for measuring a misalignment amount according to claim 9, comprising a movable stage making it possible to adjust the orientation of laser beam emitted from said laser beam source.

11. An apparatus for measuring a misalignment amount according to claim 9, in which said second target element can be moved in the plane approximately perpendicular to the orientation of said laser beam within an image-taking cycle by said image-taking device.

12. An apparatus for measuring a misalignment amount according to claim 7, comprising a movable stage making it possible to adjust the orientation of laser beam emitted from said laser beam source.

13. An apparatus for measuring a misalignment amount according to claim 12, in which said image-taking device is mounted onto said movable stage so that the orientation of the laser beam emitted from said laser beam source can be adjusted in a unified manner with the optical axis of said image-taking device.

14. An apparatus for measuring a misalignment amount according to claim 7, in which said first target element can be moved in the plane approximately perpendicular to the orientation of said laser beam within an image-taking cycle by said image-taking device.

15. An apparatus for measuring a misalignment amount according to claim 2 in which at least three rolling rolls are disposed at each of stands that constitute said continuance mill, wherein said image processing device is capable of:

extracting the edge portion of said each rolling roll based on the region corresponding to said caliber profile within the above taken image;

detecting the groove bottommost point of said each rolling roll based on the distance from the edge portion extracted as above to a PIXEL or the nearby PIXEL of the relative position calculated as above corresponding to the pass-line; and, calculating the relative center position of the virtual circle, traversing at least three groove bottommost points among the groove bottommost points of rolling rolls detected as above, to determine the relative center position of the region corresponding to said caliber profile.

16. A measuring apparatus of a misalignment amount according to claim 15, wherein said image processing device is capable of extracting the edge portion of each rolling roll by applying sub-PIXEL process based on the density gradient between two adjacent PIXELs.

17. An apparatus for measuring a misalignment amount according to claim 16, wherein said image processing device comprises an image memory of not less than 10-bit grayscale to thereby apply processing steps for the images taken into said image memory.

18. An apparatus for measuring a misalignment amount according to claim 2 in which two rolling rolls are disposed at each of stands that constitute said multi-stage rolling mill, wherein said image processing device is capable of:

extracting the edge portion of said each rolling roll based on the region corresponding to said caliber profile within the above taken image;

detecting the groove bottommost point of said each rolling roll based on the distance from the edge portion extracted as above to a PIXEL or the nearby PIXEL of the relative position calculated as above corresponding to the pass-line; and, calculating the midpoint of the line segment spanning the two discrete groove bottommost points to determine the relative center position of the region corresponding to said caliber profile.

19. An apparatus for measuring a misalignment amount according to claim 18, wherein said image processing device is capable of extracting the edge portion of each rolling roll by applying sub-PIXEL process based on the density gradient between two adjacent PIXELs.

20. An apparatus for measuring a misalignment amount according to claim 2, wherein said image processing device comprises an image memory of not less than 10-bit grayscale to thereby apply processing steps for the images taken into said image memory.

* * * * *